United States Patent [19]

Murton

[11] 4,065,000

[45] Dec. 27, 1977

[54] PHARMACEUTICAL TABLET AND CAPSULE COUNTER

[76] Inventor: Gary Murton, P.O. Box 1391, Sonora, Calif. 95370

[21] Appl. No.: 692,529

[22] Filed: June 3, 1976

[51] Int. Cl.[2] ..... G07D 9/06

[52] U.S. Cl. ..... 214/1 C; 133/8 R

[58] Field of Search ..... 214/1 C; 133/8 R; 222/572; 141/246, 247, 334

[56] References Cited

U.S. PATENT DOCUMENTS

| | | | |
|---|---|---|---|
| 2,623,647 | 12/1952 | Erickson | 214/1 C |
| 3,150,785 | 9/1964 | Clasen | 214/1 C |
| 3,255,894 | 6/1966 | Handel | 214/1 C |

FOREIGN PATENT DOCUMENTS

| | | | |
|---|---|---|---|
| 1,263,927 | 5/1969 | United Kingdom | 214/1 C |

*Primary Examiner*—Robert J. Spar

*Assistant Examiner*—George F. Abraham

*Attorney, Agent, or Firm*—Robert C. Colwell

[57] ABSTRACT

A pharmaceutical tablet and capsule counter comprises an open box having a slotted plate mounted above and parallel to the bottom of the box, a movable partition disposed between the slotted plate and the bottom of the box to divide the interior into two regions of selectable size, and a movable counting plate disposed on the upper surface of the slotted plate. An array of openings of desired shape and size in the movable counting plate are positioned so pharmaceutical tablets or capsules may be distributed across the surface of the counting plate. Repositioning of the counting plate with respect to the underlying slotted plate allows tablets or capsules to pass through the slots in the slotted plate and collect in the two regions of the base compartments. The items in one compartment may be returned to a stock supply while those in the other are dispensed to a customer.

1 Claim, 3 Drawing Figures

PHARMACEUTICAL TABLET AND CAPSULE COUNTER

BACKGROUND OF THE INVENTION

1. Field of the Invention

This invention relates to a portable pharmaceutical tablet and capsule counter, which more generally may be used for the counting of small suitably shaped objects.

2. Description of the Prior Art

Pharmaceutical tablet counting devices are known in the art, and have been the subject of several patents. For example, U.S. Pat. No. 3,662,904 entitled "Counting Device" and issued to Tune, discloses a unit for counting tablets in which a perforated plate is mounted on top of an intermediate withdrawable plate in a box-shaped based. Tablets are deposited on the perforated plate, and when all holes in the plate are filled, the withdrawable floor is removed, allowing the tablets to fall to the bottom of the box.

U.S. Pat. No. 2,623,647 "Counting Device" and issued to Erickson, discloses a device in which two perforated plates are situated adjacent to each other. After the performations on the upper plate are filled with tablets, it is moved so that its perforations correspond with the perforations of the lower plate, thereby allowing the tablets to fall into a lower container.

Several other U.S. patents also rely upon perforated plates for the counting of tablets. See, e.g., U.S. Pat. No. 3,402,827 entitled "Portable Pill Counter" and issued to White; U.S. Pat. No. 3,848,395 entitled "Means for and Methods of Dispensing Medicinal Tablets and Capsules" and issued to Totten; U.S. Pat. No. 3,150,785 entitled "Pill Counting Device" and issued to Clasen; U.S. Pat. No. 2,706,072 entitled "Tablet Counter and Packager"and issued to Furno; and U.S. Pat. No. 2,863,572 entitled "Device for Counting Pills" and issued to Bethard, et al.

Some of these prior art devices can only count tablets, and cannot accurately count capsules. Others of these devices are cumbersome to operate and require counter space far in excess of the devices' dimensions. For example, one prior art device requires space approximately twice the base area of the device if the intermediate withdrawable floor is fully removed from the device in conjunction with counting large numbers of tablets. Other such devices are difficult to clean and maintain because of the difficulty in disassembling the device. Of course, cleanliness is absolutely necessary if different varieties of tablets or capsules are to be dispensed utilizing a single device, rather than a separate device for each type of tablet or capsule.

SUMMARY OF THE INVENTION

The present invention provides a mechanism for counting tablets and capsules superior to those previously existing machines or devices. The present invention is easily disassembled for cleaning, thereby facilitating the dispensing of different varieties of pharmaceutical products. Additionally, the present invention is compact in size, requiring counter space equal only to the dimensions of its base. Further, by substituting only a few different counting plates, the present invention may be utilized for counting either tablets or capsules of a wide variety of sizes. The limited number of counting plates necessary to count a wide range of tablets and capsules reduces the space, time, and equipment necessary for use of this device. Also, because of its simplicity of design and the absence of associated mechanical devices necessary for counting, the present invention may be manufacted quickly and inexpensively, thereby being made available to even those pharmacists dispensing only a limited number of prescriptions.

A pharmaceutical tablet and capsule counter comprises a base, a slotted plate mounted above and parallel to the base, a slideable partition for dividing the volume between the slotted plate and the bottom of the base into two regions, and a counting plate disposed on the upper surface of the slotted plate and having an array of openings of selected size and shape. The size and shape of the openings in the counting plate are dependent upon the nature of the tablets, capsules, or other objects to be counted by the device. For example, if small tablets are to be counted, the openings in the counting plate will typically be circular, having a diameter greater than that of the type of tablet to be counted, but smaller than twice the diameter of the type of tablet to be counted. If capsules or large tablets are to be counted, the counting plate typically will have semicircular openings suitable for counting either one or two capsules or tablets per opening. Because the semicircular holes in some embodiments of the counting plate allow counting of both tablets and capsules, this invention, unlike prior art devices, does not require a large variety of counting plates.

To operate the tablet and capsule counter of this invention, the user selects the appropriate counting plate and positions it upon the slotted base plate placing the holes in the counting plate over the solid portions between the slots in the slotted plate. Tablets or capsules are then poured across the counting plate and the device manipulated until each of the holes in the counting plate is filled. Those excess tablets or capsules which do not lodge in an opening in the counting plate are removed from the device by tilting it toward one end thereby causing the objects to slide into a trough at that end. The counting plate is then displaced with respect to the underlying slotted plate allowing the tablets or capsules to fall through the slots in the slotted plate and into the base of the device. A movable partition in the base may be positioned to divide the base into two portions which will separate the desired number of objects from those objects passing through the counting plate and slotted base plate.

DETAILED DESCRIPTION

Figure 1:
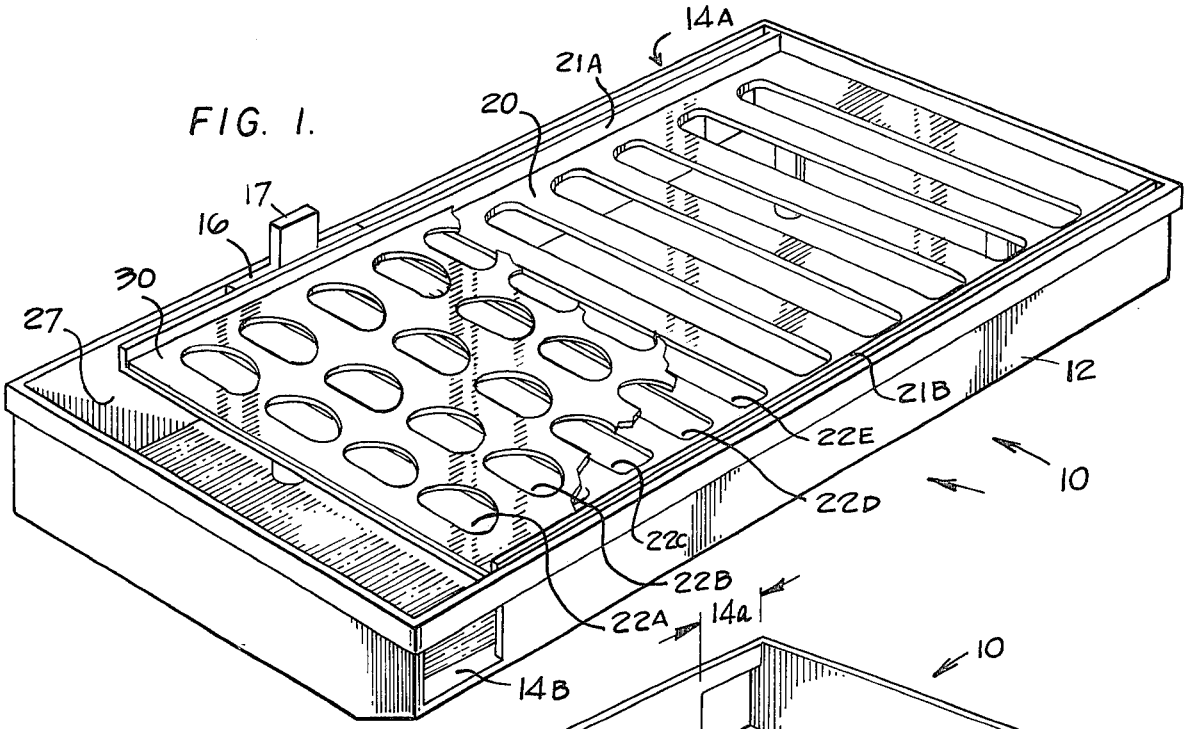
FIG. 1 shows a view of the invention as it appears in use, with a portion of the counting plate cut away to display the underlying slotted plate.
Figure 2:
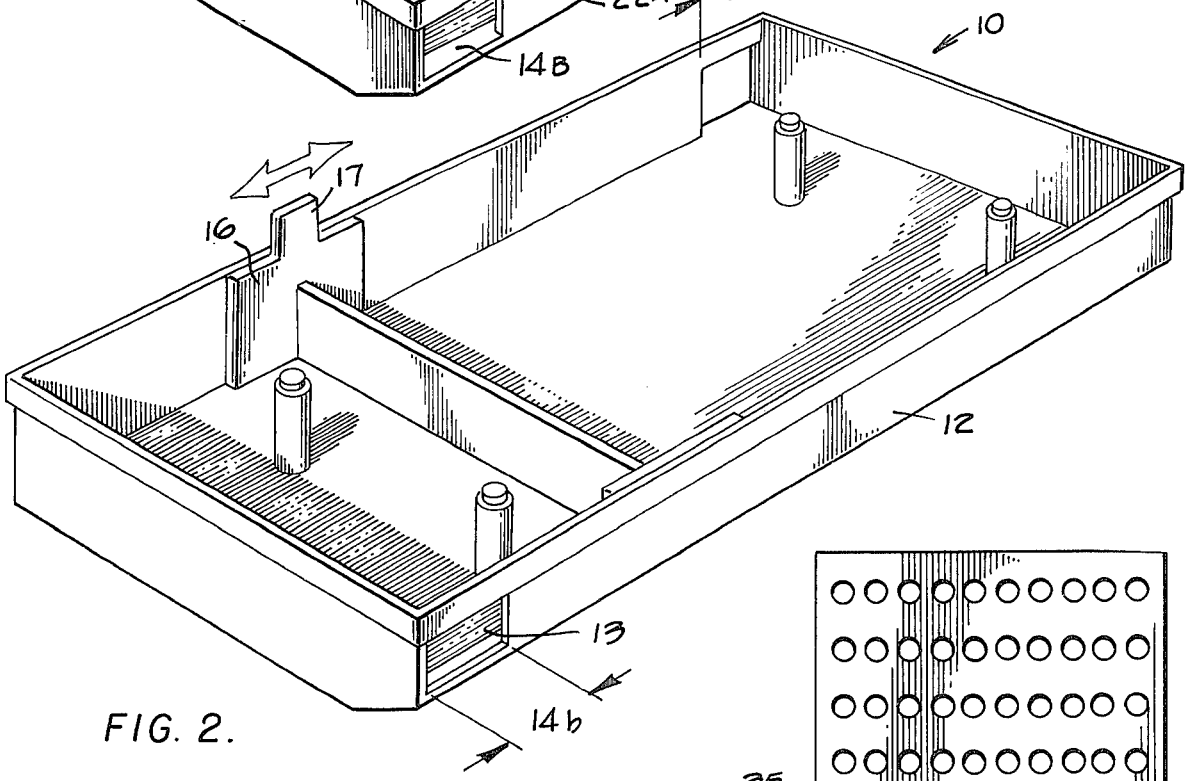
FIG. 2 shows a view of the device with the slotted plate and counting plate removed.

The pharmaceutical tablet and capsule counter 10 shown in FIG. 1 comprises an open topped rectangular shaped box 12 having openings 14A and 14B in opposite corners. A movable partition 16 beneath slotted plate 20 extends from one side of the rectangular base 12 to the opposite side. Movable partition 16 is suitably sized to prevent objects from passing around or over it from one end of base 12 to the other. Slotted plate 20 does not extend throughout the full area of base 12, but has a length slightly less than the length of base 12, thereby forming a trough 27 at one end of base 12. Shallow side rails 21A and 21B extend along the length of the two sides of slotted plate 20. Slots 22A, 22B, 22C, 22D, etc. are formed in slotted plates 20 at selected intervals. Typically, the dimensions of the slots 22 and intervals there between will depend upon the size of the objects to be counted by the pharmaceutical tablet and capsule counter 10. For example, if generally large objects are to be counted, then the slots 22 will be spaced a greater distance apart, and will each individually have a greater width. On the other hand, for smaller objects, the slots 22 may be smaller and clustered more closely together. In one embodiment of this invention suitable for counting nearly all pharmaceutical tablets and capsules, the slots are 9/16 inch by 5⅝ inches and are separated by 7/16 inch. In this embodiment slotted plate 20 is 3 3/16 inches by 6 inches and side rails 21A and 21B are ½ inch in height. Base 12 is 13 7/16 by 6⅞ inches and has a depth of 2 1/16 inches. Obviously the dimensions of this invention may be varied to adapt to the dimensions of the objects being counted, for example, small machine parts, coins, etc.

Figure 3:
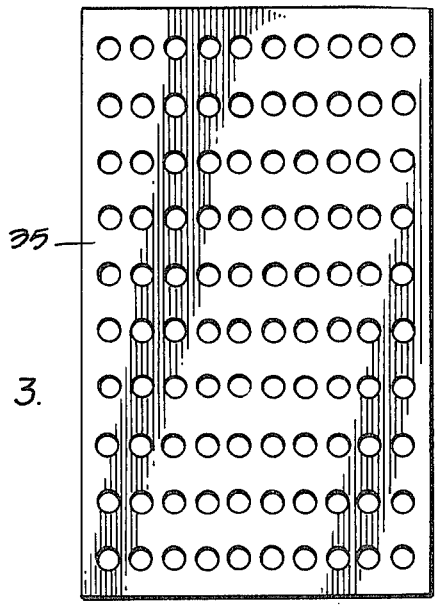
FIG. 3 is a plan view of a counting plate useful for counting both capsules and tablets.

Counting plate 30 is disposed directly above slotted plate 20 and rests thereon. Counting plate 30 will typically have dimensions approximately equal to the dimensions of slotted plate 20. Additionally, an array of perforations is made in counting plate 30. Typically, these perforations will be arranged in columns and rows with the spacing of the columns and rows corresponding to the spacing of the slots in slotted plate 20. In one embodiment shown in FIG. 3, a counting plate 35 has an array of 100 holes arranged in ten rows and ten columns. Each of the holes is ⅜ inch in diameter. In another embodiment, shown in FIG. 1, counting plate 30 has an array of semicircular shaped holes. In one embodiment counting plate 30 has an array of 50 semicircular holes, each being half of a circle having a diameter of 1 inch. In yet another embodiment found useful in counting pharmaceutical tablets and capsules, the semicircular holes of counting plate 30 are each half a circle of diameter ⅞ inch. I have discovered that the semicircular holes as depicted in FIG. 1 on counting plate 30 are particularly suitable for the counting of both large tablets and capsules with equal ease and accuracy. The semicircular holes allow either one large capsule or two small capsules to fit into the hole, thereby eliminating the need to utilize separate counting plates for tablets and capsules. The use of circular holes in conjunction with the counting of capsules leads to frequent errors as varying numbers of capsules may collect in a circular hole of given size.

Operation of the pharmaceutical tablet and capsule counter is simple, and will be described herein with respect to dispensing tablets. This description should not be read as limiting the use of this invention to this particular use. A counting plate, for example plate 30 or plate 35, is first selected. I have discovered that the use of three counting plates, one having circular holes of ⅜ inch diameter and two having semicircular holes of radius ½ inch and 7/16 inch, respectively, is suitable for the counting of approximately 95% of all pharmaceutical tablets or capsules.

The selected counting plate is placed upon slotted plate 20 and positioned so that the openings in the counting plate corresponding to the regions between the slots 22A, 22B, etc., on slotted plate 20. The base divider 16 is manually positioned by utilizing the projecting handle 17 to allow counting of the desired number of tablets or capsules. For example, if 70 tablets are desired and counting plate 35 is used, movable partition 16 is positioned between the seventh and eighth rows of counting plate 35, thereby leaving seven full rows of 10 tablets each between the slideable base divider and the opening 14A in base 12.

A sufficient number of tablets or capsules are then poured onto the surface of counting plate 30. By gently shaking base 12 of the pharmaceutical tablet and capsule counter 10, the tablets are distributed across the surface of counting plate 30 to lodge in the individual openings of the selected counting plate. In rare instances manual manipulation of the tablets being counted may be necessary to fill any openings in the counting plate not already filled. Once all openings on the counting plate are filled with tablets, the tablet and capsule counter 10 is tilted to allow the excess tablets to slide into trough 27 at one end of the device. These excess tablets now may be returned to the stock supply from which they came. Alternatively this step in the operation of the counter may be delayed until after the selected number of tablets are dispensed.

Counting plate 30 is then displayed slightly toward trough 14A, thereby allowing the tablets to drop from the openings in counting plate 30 through the slots in slotted plate 20 and into the base region of the counter 10. Counter 10 then may be manipulated to dump the 70 tablets from opening 14A into the desired bottle, envelope, or other container in which the tablets will be delivered to the customer. The other 30 tablets or capsules plus any excess tablets already in trough 27 now may be returned to the stock supply.

The tablet and capsule counter of this invention provides an accurate, versatile, inexpensive and simple means for counting all varieties of pharmaceutical tablets and capsules, and may be readily adapted to count other small objects. The simple design is almost maintenance-free, and may be easily and quickly cleaned between uses.

I claim:

1. Apparatus comprising:

a base comprising a rectangular box with bottom and sides but without a top, and having openings in the sides at two opposite corners;

a slotted plate having a single row of slots, said slotted plate being rectangular and being disposed parallel to and at a selected distance from the bottom of the base, said distance being less than the height of the sides of the rectangular box to thereby form a region within the base and beneath the slotted plate;

a removable rectangular counting plate slidably disposed on the slotted plate for movement parallel to said sides, said counting plate having an array of openings of semicircular shape arranged in rows and columns wherein the rows are parallel to the slots in the slotted plate;

a slidably movable partition disposed between the slotted plate and the bottom and sides of the base, said partition being less thick than the distance separating adjacent rows of openings in the counting plate and said partition being disposed perpendicular to the bottom and sides of the base to thereby divide the region within the base and beneath the slotted plate into two separate portions; and wherein the number of slots in the slotted plate is equal to the number of rows of openings in the counting plate, wherein the rows of openings in the counting plate are spaced a distance apart equal to the spacing of the slots and the width of the slots is at least as great as the corresponding dimension of a row of the openings in the counting plate.

* * * * *